US006374948B1

(12) United States Patent
Stack et al.

(10) Patent No.: US 6,374,948 B1
(45) Date of Patent: Apr. 23, 2002

(54) RAIL LUBRICATOR

(75) Inventors: Daniel P. Stack, Wexford, PA (US); William G. Angel, Colorado Spring, CO (US); W. Thomas Urmson, Jr., Valencia, PA (US)

(73) Assignee: Portec Rail Products, Inc., Pittsburgh, PA (US)

( * ) Notice: Subject to any disclaimer, the term of this patent is extended or adjusted under 35 U.S.C. 154(b) by 0 days.

(21) Appl. No.: 09/429,385

(22) Filed: Oct. 28, 1999

(51) Int. Cl.[7] ..... B61K 3/00

(52) U.S. Cl. ..... 184/3.2; 104/2; 105/72.2; 105/215.2

(58) Field of Search ..... 184/3.1, 3.2, 5, 184/21, 22, 23; 104/2, 15, 279; 105/72.2, 215.2; 291/3

(56) References Cited

U.S. PATENT DOCUMENTS

| | | | | | |
|---|---|---|---|---|---|
| 531,993 | A | * | 1/1895 | Ferguson | 184/23 |
| 1,081,419 | A | * | 12/1913 | Youtsey | |
| 2,233,635 | A | * | 3/1941 | Northausen | 184/23 |
| 2,541,514 | A | * | 2/1951 | Herold | 105/215.2 |
| 2,586,256 | A | * | 2/1952 | Quarles | |
| 2,986,102 | A | * | 5/1961 | Cox | 105/72.2 |
| 3,103,897 | A | * | 9/1963 | Bonanno et al. | 184/3.2 |
| 3,338,184 | A | * | 8/1967 | Fisher | 105/215.2 |
| 3,542,153 | A | * | 11/1970 | Philips | 184/3.2 |
| 3,892,187 | A | * | 7/1975 | White, Jr. | 105/215.2 |
| 3,980,025 | A | * | 9/1976 | Olson, Sr. et al. | 105/72.2 |
| 4,632,038 | A | * | 12/1986 | Lawrence | 104/120 |
| 4,736,818 | A | * | 4/1988 | Wolfe | 184/3.2 |
| 5,138,952 | A | * | 8/1992 | Low | 105/72.2 |
| 5,156,639 | A | * | 10/1992 | Bostrom | 105/72.2 |
| 5,236,063 | A | | 8/1993 | Nelson et al. | 184/3.2 |
| 5,337,860 | A | * | 8/1994 | Burke et al. | 184/3.2 |
| 5,477,941 | A | * | 12/1995 | Kumar et al. | 184/3.2 |
| 5,687,814 | A | | 11/1997 | Craig et al. | 184/3.2 |
| 5,704,295 | A | * | 1/1998 | Lohr | 105/72.2 |
| 5,758,583 | A | * | 6/1998 | Lohr | 105/72.2 |
| 5,896,947 | A | * | 4/1999 | Kumar | 184/3.2 |
| 5,992,568 | A | | 11/1999 | Craig et al. | 184/3.2 |

FOREIGN PATENT DOCUMENTS

| | | | | |
|---|---|---|---|---|
| AU | 13014/33 | * | 6/1934 | 184/23 |

* cited by examiner

*Primary Examiner*—David A. Bucci
*Assistant Examiner*—Chong H. Kim
(74) *Attorney, Agent, or Firm*—Webb Ziesenheim Logsdon Orkin & Hanson, P.C.

(57) ABSTRACT

A device for lubricating a track or a rail that is adapted to be mounted tog wheeled vehicle. The device includes a frame member adapted to be mounted to the vehicle and an arm pivotally attached to the frame member. A roller, which is adapted to ride on the rail, mounts to the arm. A lubricating nozzle is secured to the arm.

27 Claims, 9 Drawing Sheets

RAIL LUBRICATOR

BACKGROUND OF THE INVENTION

1) Field of the Invention

The present invention relates to a device for lubricating railroad rails which is mountable to a track vehicle.

2) Description of the Prior Art

It has long been the practice to apply grease, friction modifying materials or similar gel-like lubricants to the sides of rails at curves, switches and other parts of the railroad track. Such materials are applied to the sides of the rail to reduce the friction which occurs as the flanges of the train's wheels contact the sides of the rail. Lubricants and/or friction controlling gels are also applied to the top of the rail. The friction reduction results in reduction of wear of both the rail and the wheels and reduces fuel consumption of the locomotion of the train and reduces squealing noises.

Devices for lubricating rails are already known, such as U.S. Pat. No. 5,687,814. Typically, these devices for lubricating rails are mounted on a track vehicle, such as a pickup truck equipped with additional flanged wheels. The lubricating nozzle of the device is secured to a rail gear mounted to a truck body.

As shown in FIG. 1A, preferably, devices for lubricating rails should direct lubricants 1 and 2 along a straight line at a constant fixed distance as measured from a head of a rail 3 and along a straight line at the top of the head. However, due to the suspension of the track vehicle and the varying weight of the vehicle due to varying loads, the positions of the lubricants 1' and 2' vary on the rail 3' as shown in FIG. 1B. These varying positions of the lubricants can cause excessive waste, inefficient lubricant use and locomotion traction problems if the lubricant is mistakenly placed on the top of the rails.

Therefore, it is an object of the present invention to provide a device for lubricating a rail that can accurately apply lubricant and/or friction modifying material to a rail.

SUMMARY OF THE INVENTION

The present invention is a device for lubricating a rail that includes a mounting frame, a first support frame, a roller and a lubricating nozzle. The first support frame includes a first end and a second end. The second end is pivotally secured to the mounting frame. The roller is rotatably secured to the first end of the first support frame and is adapted to ride on a rail. The roller is adapted to rotate about a first axis relative to the first support frame. The lubricating nozzle is mounted to the first support frame for directing lubricant toward a rail.

The device for lubricating a rail can further include a biasing member having two ends, one end mounted to the mounting frame and the other end mounted to the support frame. The biasing member assists in maintaining the support frame in a first position and a second position. The first position maintains the roller in an engaged position with a rail and the second position maintains the roller in a disengaged position. The biasing member can include a gas charged chamber and a piston slidably received by the chamber, where the piston is biased relative to the chamber.

The roller can include a tapered surface defining a recess adapted to receive a portion of the rail. The tapered surface can include a first tapered surface spaced apart from a second tapered surface. The first tapered surface may be dissimilar from the second surface.

Preferably, the first tapered surface and the second tapered surface are frusto-conical shaped and have differing base diameters. More preferably, the roller is made of an electrically insulating material.

Preferably, the first support frame is pivotally secured to the mounting frame and pivots about a second axis parallel to the first axis. Alternatively, the first support frame may be secured to the mounting frame to pivot about a second axis which is not parallel to the first axis. The mounting frame can include a pivot bracket pivotably secured to a mounting bracket frame. The second end of the first support frame is pivotably secured to the pivot bracket. The pivot bracket in the first support frame pivots about a second axis relative to the mounting bracket frame and the first support frame pivots about a third axis relative to the pivot bracket, wherein the first axis and third axis are parallel to each other and the second axis is not parallel to the first axis and the third A stop may be secured to one of the mounting bracket frames and the pivot bracket. The stop is adapted to contact the other of the pivot bracket and the mounting bracket frame to limit pivotal movement of the pivot bracket relative to the mounting bracket frame. The stop is adjustable to limit pivotal movement of the pivot bracket relative to the mounting bracket frame. The stop may be a threaded member threadably received by the pivot bracket.

The present invention may also include a second lubricating nozzle mounted to the first support frame for directing a lubricant toward a rail. One of the nozzles is arranged to direct lubricant toward the top portion of the rail and the other of the lubricating nozzles arranged to direct a lubricant toward a side portion or gage face of the rail. Preferably, the first support frame includes two spaced apart arms wherein the roller is positioned between the arms. The present invention may further include a centering spring having two ends, one end secured to the mounting bracket frame and the other end mounted to the pivot bracket. The centering spring may be a torsional spring.

The present invention may further include a bumper to which the mounting frame is secured. A second mounting frame may be secured to the bumper. A second support frame is secured to the second mounting frame. A roller is rotatably secured to the second support frame and a lubricating nozzle is mounted to the second support frame for directing lubricant toward a rail, wherein the mounting frames are spaced apart from each other.

The present invention is also a combination that includes the above-described device for lubricating the rail and a wheeled vehicle having a bumper, wherein the device for lubricating the rail is mounted to the bumper.

DESCRIPTION OF THE PREFERRED EMBODIMENTS

Figure 1B:
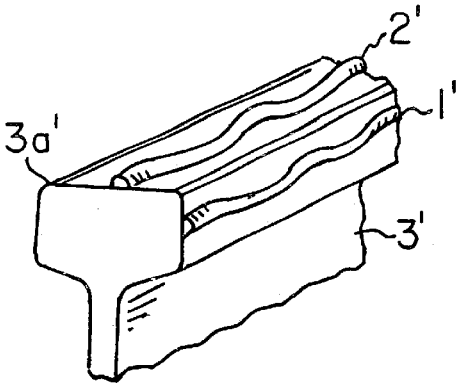
FIG. 1B PRIOR ART
FIG. 1B is a perspective view of a rail with a lubricant applied to the rail in a non-uniform manner.
Figure 1A:
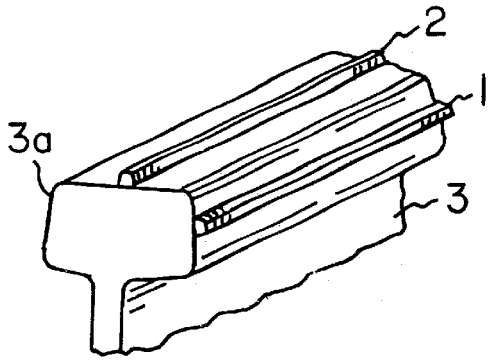
FIG. 1A is a perspective view of a rail with a lubricant applied to a rail in a uniform manner.
Figure 2:
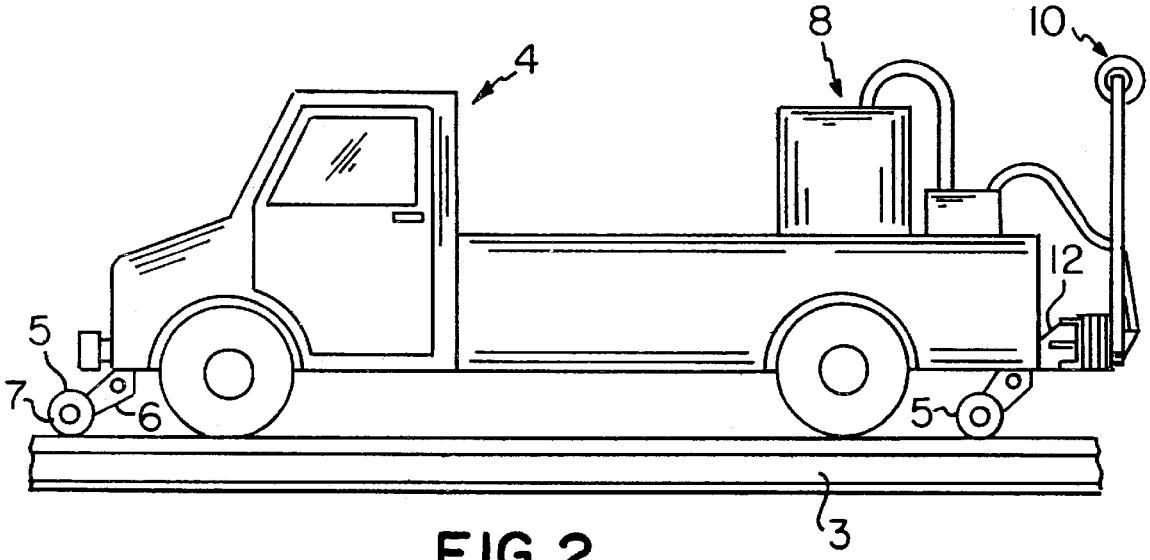
FIG. 2 is an elevation of a device for lubricating a rail made in accordance with the present invention, which is attached to a pickup truck.

FIG. 2 shows a pickup truck 4 engaged with rails 3 (of which only one rail 3 is shown) via rail gears 5. Rail gears 5 are known in the art and include, respectively, arms 6 and guide wheels 7 pivotally secured thereto. The arms 6 are secured to the pickup truck 4. The pickup truck 4 also includes a friction modifier supply 8, which supplies a friction modifying material to two spaced apart rail lubricators 10 or devices for lubricating rails, made in accordance with the present invention. Each rail lubricator 10 is secured to a bumper 12 of the pickup truck 4.

Figure 4:
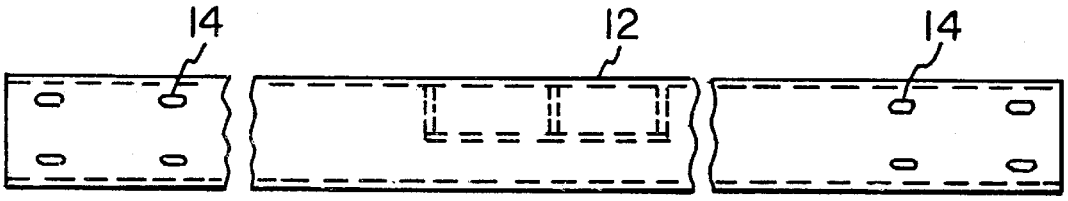
FIG. 4 is an elevation of the bumper shown in FIG. 3.
Figure 3:
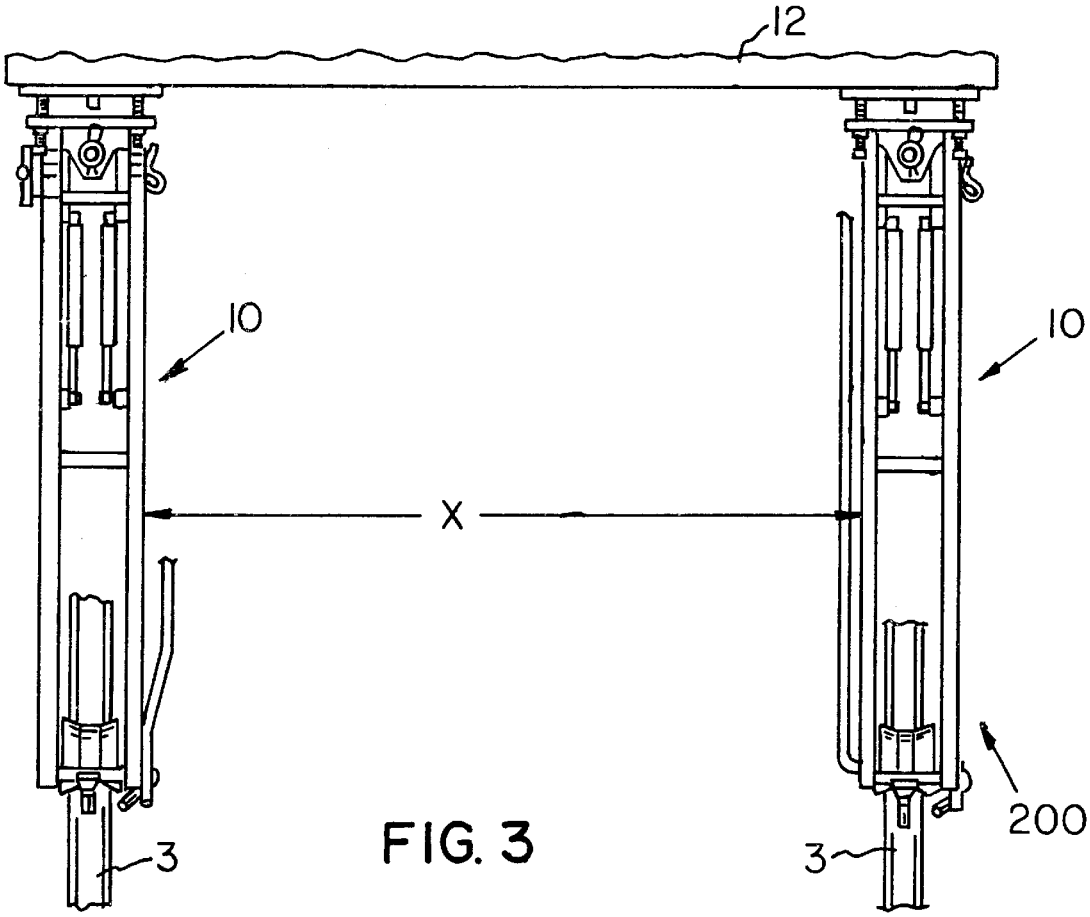
FIG. 3 is a plan view of the device for lubricating a rail made in accordance with the present invention, which is attached to a bumper of the pickup truck shown in FIG. 2.
Figure 7:
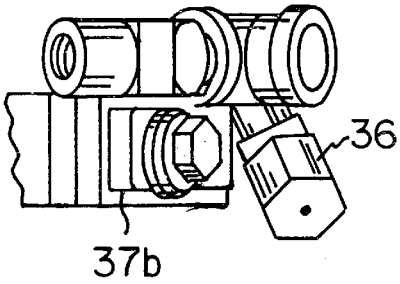
FIG. 7 is a top plan view of a nozzle shown in FIG. 5.
Figure 8:
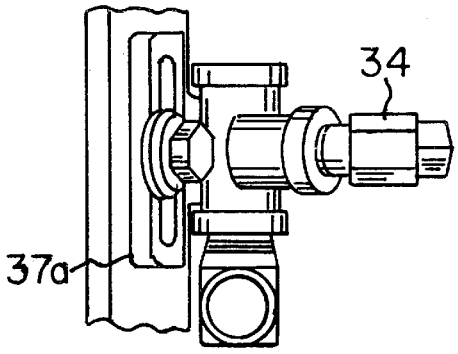
FIG. 8 is a top plan view of another nozzle shown in FIG. 5.
Figure 9:
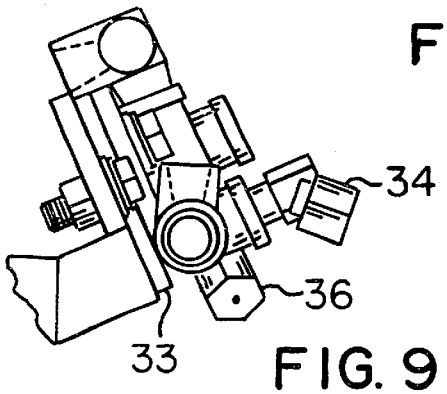
FIG. 9 is an elevation of the nozzles shown in FIGS. 7 and 8.

Referring to FIG. 3, the rail lubricators 10 are spaced apart a distance X and engage respective spaced apart rails 3. The rail lubricators 10 are secured by fasteners to the bumper 12. The fasteners, such as threaded bolts and nuts, as shown in FIGS. 2 and 3, pass through respective slots 14 as shown in FIG. 4.

Figure 5:
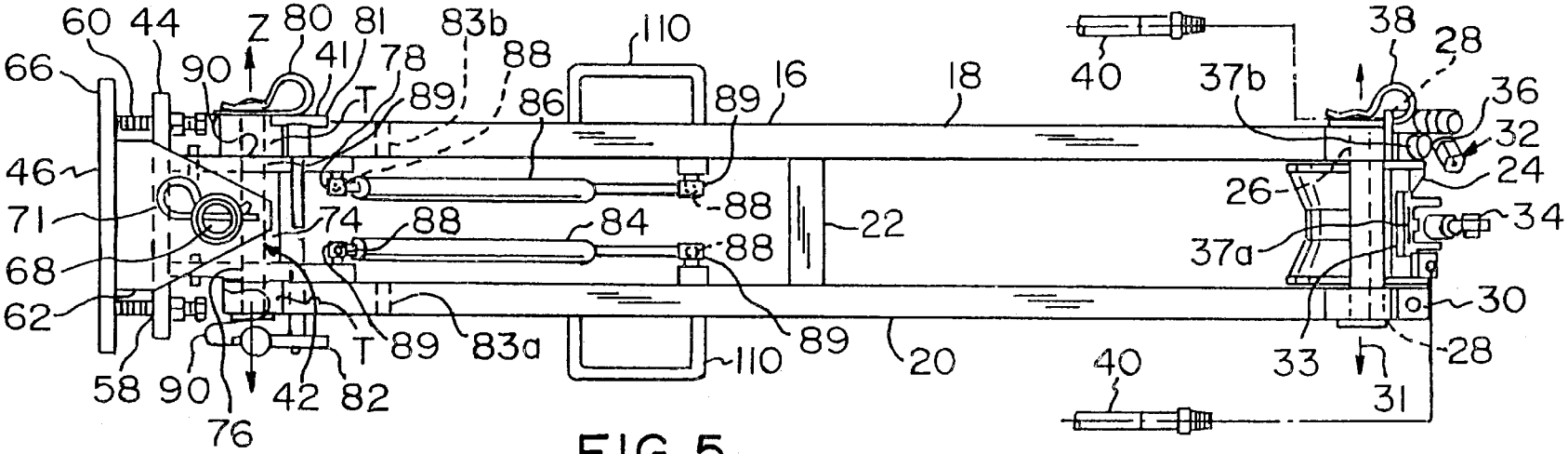
FIG. 5 is a top plan view of the device for lubricating a rail shown in FIG. 2.
Figure 6:
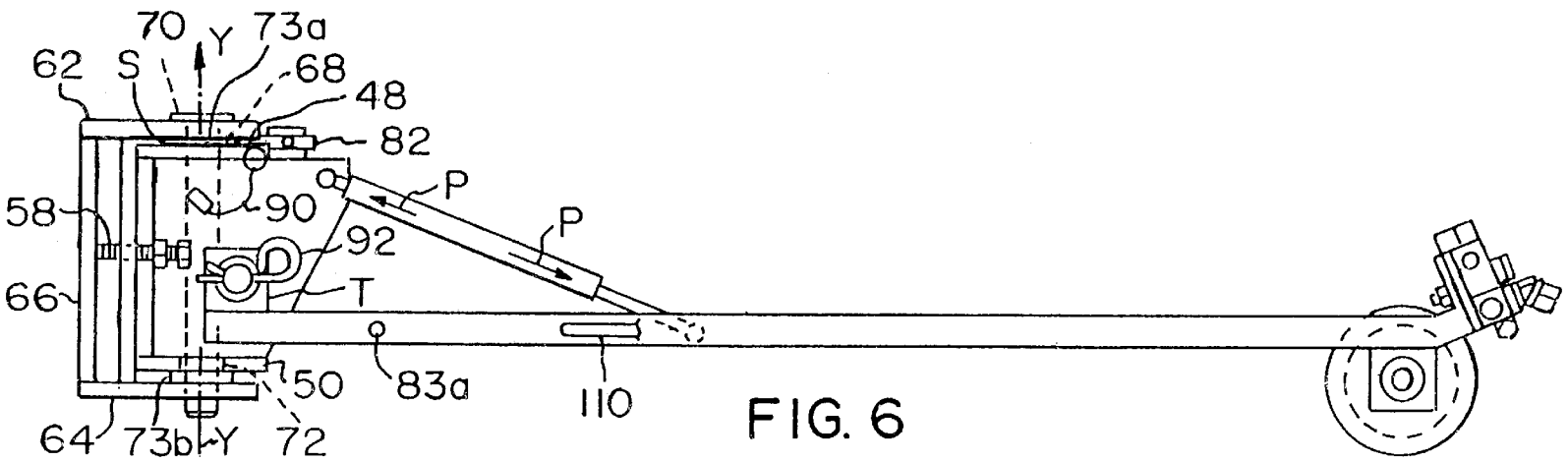
FIG. 6 is an elevation of the device shown in FIG. 5.
Figure 10:
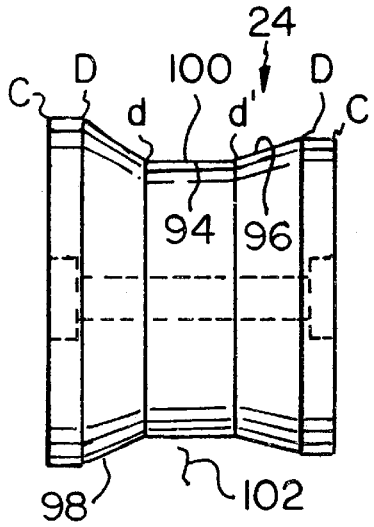
FIG. 10 is an elevation of a roller of the device for lubricating a rail shown in FIG. 2.

Referring now to FIGS. 5–9, each rail lubricator 10 includes a frame or support frame 16 that is made up of two spaced apart parallel arms 18 and 20 secured to each other through a cross member 22. A roller 24, as shown in FIGS. 5, 6 and 10, is rotatably secured to the arms 18 and 20 through a shaft 26 and bearings 28 positioned at a first end 30 of the rail lubricator frame 16. The roller 24 is adapted to rotate about an axis 31 relative to the frame 16 and is positioned between the arms 18 and 20.

A nozzle assembly 32 is also secured to the first end 30 of the frame 16. The nozzle assembly 32 is adapted to direct friction modifying materials toward a respective rail 3. The nozzle assembly 32 includes a bracket 33 secured to the frame 16 at arms 18 and 20. Nozzles 34 and 36 are secured to the bracket 33 and are adapted to direct friction modifying material to the top portion of the rail and side portion of the rail, respectively. Each nozzle 34 and 36 includes adjustment brackets 37A and 37B that are secured to the bracket 33 via threaded bolts. Slots are defined in brackets 37A and 37B for adjustment of the nozzles 34 and 36 relative to each other. A pin 38 is removably received by the shaft 26 to enable removal of the roller 24 from the frame 16. Specifically, the pin 38 can be removed from the frame to permit removal of the shaft 26 from the frame 16, thereby permitting the roller 24 to be removed from the frame 16. Hoses 40 are secured to nozzles 34 and 36 for supplying the nozzles with friction modifying material. By friction modifying material, it is meant to include both friction increasing material or friction reducing material. Further, it is to be understood that different types of friction modifying materials can be supplied to each nozzle 34 and 36.

Figure 14:
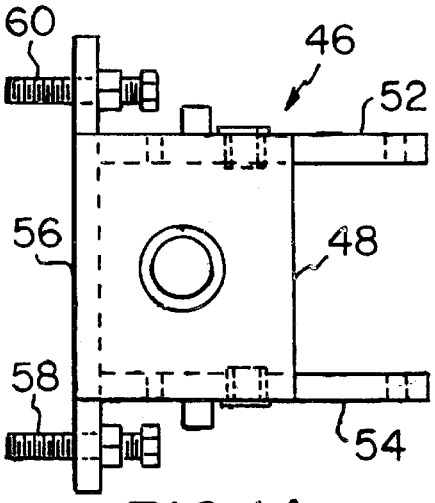
FIG. 14 is a plan view of a pivot bracket frame of the device for lubricating a rail shown in FIG. 2.
Figure 15:
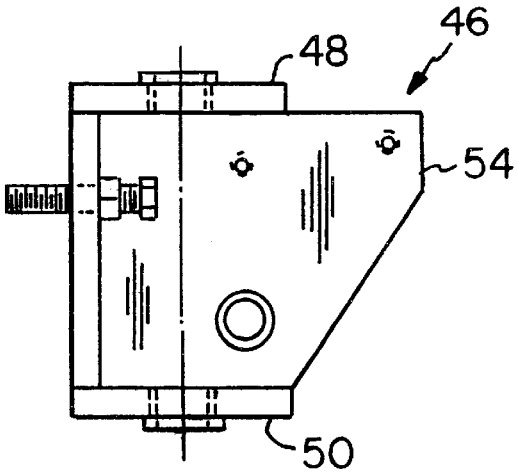
FIG. 15 is a side elevation of the pivot bracket shown in FIG. 14.
Figure 16:
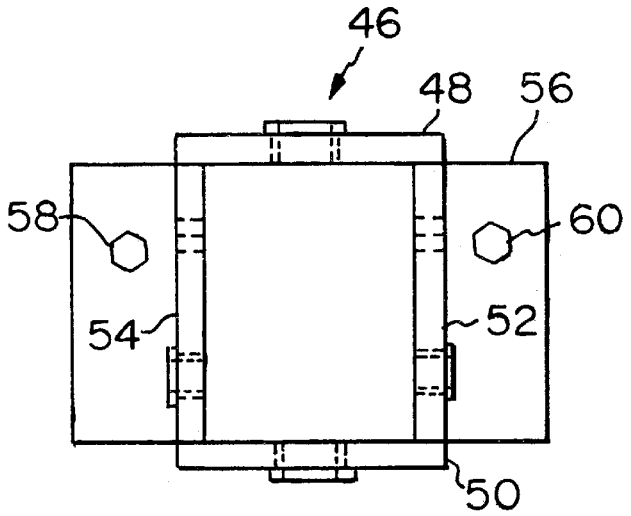
FIG. 16 is an end elevation view of the pivot bracket shown in FIGS. 14 and 15.

A second end 41 of the frame 16 is pivotably secured to a pivot frame or mounting frame 42. As shown in FIGS. 11–16, the pivot frame 42 includes a mounting bracket frame 44 and a pivot bracket 46 pivotally mounted to the mounting bracket frame 44. The pivot bracket 46, as shown in FIGS. 14–16, includes plates 48 and 50 secured to side plates 52 and 54. Plates 48 and 50 and side plates 52 and 54 are secured to a backplate 56. Two oppositely positioned stops 58 and 60, which are threaded fasteners, are threadably secured to the backplate 56.

Figure 11:
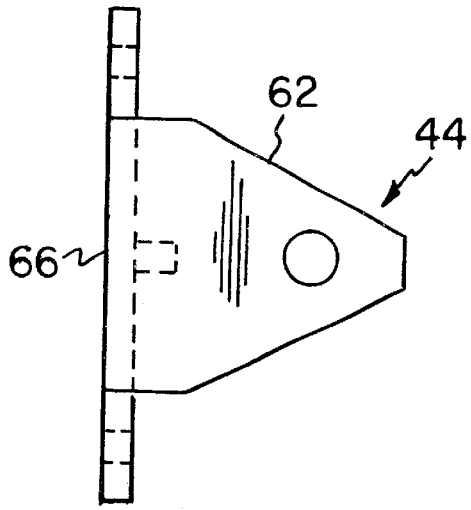
FIG. 11 is a plan view of a mounting bracket frame made in accordance with the present invention.
Figure 12:
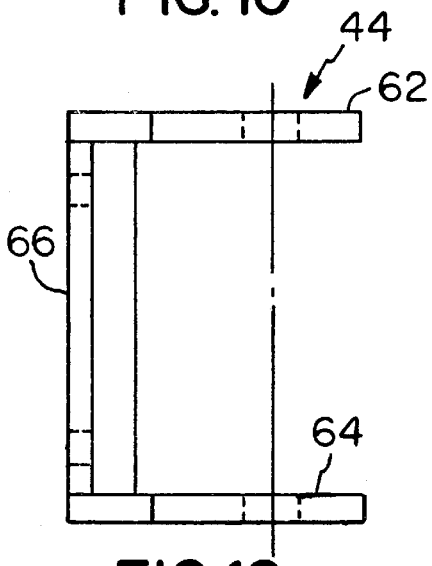
FIG. 12 is a side elevation of the mounting bracket frame shown in FIG. 11.
Figure 13:
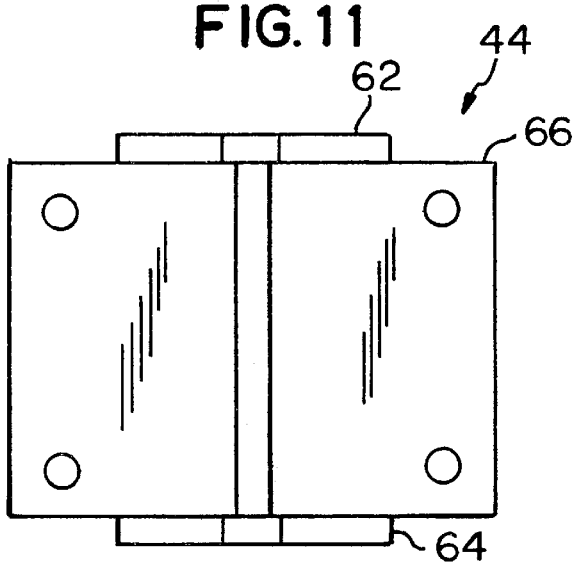
FIG. 13 is an end elevation of the mounting bracket frame shown in FIGS. 11 and 12.

The mounting bracket frame 44, as shown in FIGS. 11–13, includes an upper plate 62 spaced apart from a lower plate 64, which are secured to a rear plate 66. As shown in FIGS. 5 and 6, a shaft 68 extending along a Y-axis, passes through the plates 48, 50, 54 and 64. Bearings 70 and 72 pivotally receive the shaft 68 and are secured to plates 48 and 50 and include lips 73A and 73B. A hair pin 71 removably secures the shaft 68 in place. The bearings 70 and 72 are made of an electrically insulating material. In this arrangement, the pivot bracket 46 and mounting bracket frame 44 can pivot relative to each other about the Y-axis. Tabs T are provided at the second end 41 of the frame 16 on respective arms 18 and 20. A pivot pin 74 passes through the tabs T and the plates 52 and 54. Specifically, bearings 76 and 78 are received by plates 52 and 54 and the pivot pin 74 passes through the bearings 76 and 78. This arrangement permits the frame 16 to pivot about a Z-axis passing through the pivot pin 74 relative to the pivot frame 42, which is parallel to the axis 31. The Z-axis and the axis 31 are perpendicular and not parallel to the Y-axis. Hairpins 80 and 92 are received by the pivot pin 74 to permit removal of the pivot pin 74 from the pivot frame 42. Preferably, the bearings 76 and 78 are made of an electrically insulating material to electrically insulate the pivot frame 16 from the mounting bracket frame 46.

Figure 19:
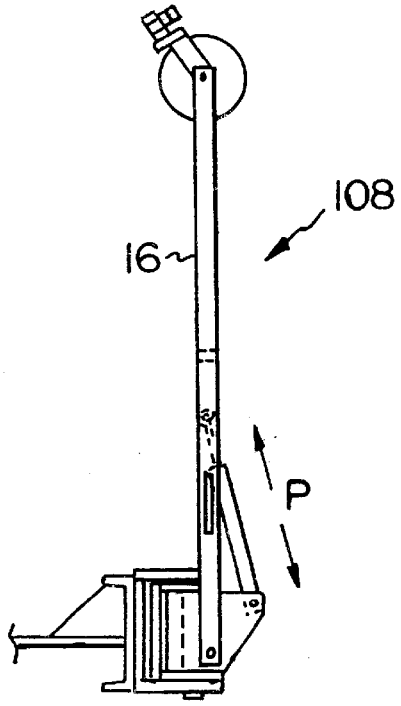
FIG. 19 is an elevation of the device for lubricating a rail in a third or disengaged position.

Lock pins 81 and 82 are provided and removably securable to tabs provided on plates 52 and 54. The tabs are positioned at the end of the lanyard 90. Bolts pass through tabs and holes defined in plates 52 and 54. The bolts are secured with flat washers, lock washers and nuts. The lock pins 81 and 82 are adapted to be removed from the tabs defined on plates 52 and 54, so that holes 83A and 83B provided in the arms 18 and 20, can be aligned with respective holes defined in the tabs of plates 52 and 54 and the lock pins 81 and 82 can be passed through the holes 83A and 83B and those provided in the tabs of plates 52 and 54 to maintain the frame 16 in a disengaged position as shown in FIG. 19.

Gas springs or biasing members 84 and 86 are secured between the opposite ends of respective arms 18 and 20. Opposite ends of the gas springs 84 and 86 are pivotally secured to the plates 52 and 54 and arms 18 and 20. Each of the gas springs 84 and 86 includes a piston slidably received by a gas charged chamber, which are well known in the art. The piston is biased relative to the chamber. Each gas spring 84 and 86 also includes ball members 88 defined on the chamber and piston which are received by respective receiving members 89 to permit the pivotal movement. Each of the lock pins 81 and 82 are also secured to the respective plates 52 and 54 through a lanyard 90. Preferably, handles 110 are secured to arms 18 and 20.

Referring back to FIG. 10, preferably the roller 24 is made of an electrically insulating material such as uhmw polyethylene. The roller 24 includes a roller surface 94 that includes a first tapered surface 96 spaced apart from a second tapered surface 98. A cylindrical surface 100 is positioned between the first tapered surface 96 and the second tapered surface 98. A recess 102 is defined between the first tapered surface 96, the second tapered surface 98 and the cylindrical surface 100. The roller 24 is adapted to contact the top portion 3A of the rail 3 on the first tapered surface 96 and second tapered surface 98 within the recess 102. The tapered surfaces 96 and 98 permit alignment of the roller 24 with the rail 3.

As can be seen in FIG. 10, the tapered surfaces 96 and 98 are dissimilar. Specifically, the tapered surfaces 96 and 98 are frusto-conical in shape having the same interior smaller diameters d and d' but differing larger exterior base diameters D and D'. Preferably, the larger base diameter tapered surface D' is positioned along the inner surfaces I of the rail 3. The roller 24 also includes cylindrical portions C and C' which are positioned adjacent tapered portions 96 and 98.

The operation of the rail lubricator device 10 will now be discussed. First, the bumper 12 is secured to the pickup truck 4. Two rail lubricators 10 are spaced apart and secured to the bumper (preferably at the rear of the pickup truck 4) through bolts passing through the rear plate 66 of the mounting bracket frame 44 and the slots 14 and as shown in FIGS. 2 and 3. The rail lubricators 10 can be slightly adjusted on the bumper 12 through tolerances of the respective slots 14 so that the rollers 24 are positioned directly above respective rails 3. Once the rail lubricators 10 are secured to the bumper 12 via the bolts, then a rail lubricator arrangement 200 is formed.

Figure 17:
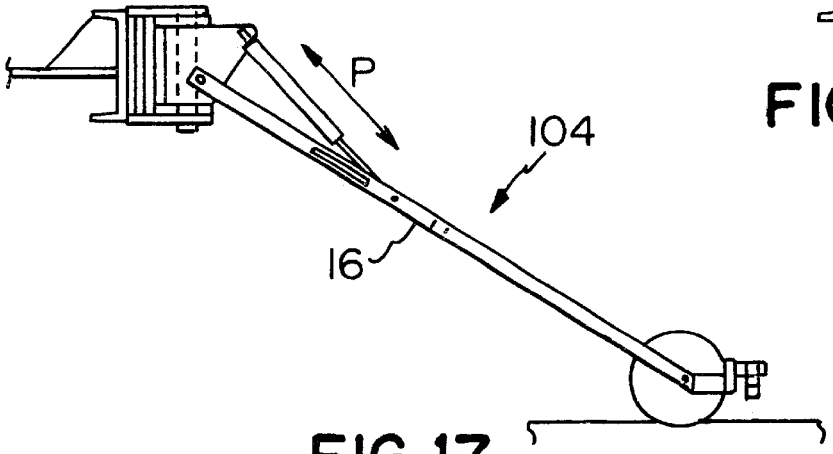
FIG. 17 is an elevation of the device for lubricating a rail in a first or engaged position.

The gas springs 84 and 86 are configured so as to apply pushing force P against the arms 18 and 20, as shown in FIG. 6. This will cause the frames 16 to be pushed downwardly toward the rail 3, as shown in FIG. 17, in a first or engaged position 104. In the first or engaged position 104, the rollers 24 engage with the rail 3 and the gas springs 84 and 86 apply a downward force P against the frame 16 so as to maintain the rollers 24 in engagement with the rails. The rail lubricators 10 can then be activated by applying pressure, via a pump to the friction modifier supply 8 so as to supply friction modifying material to nozzles 34 and 36, whereby friction modifying material can be applied to the top or side of the rail 3 or both. The gas springs 84 and 86 also assist in maintaining the rollers 24 in engagement should rollers 24 engage a bump or inconsistency on the rail 3. Further, the pivot frame 42 permits the frame 16 to rotate about the shaft 68 (and the Y-axis) so as to permit the roller 24 to turn as the track weaves and bends.

Figure 18:
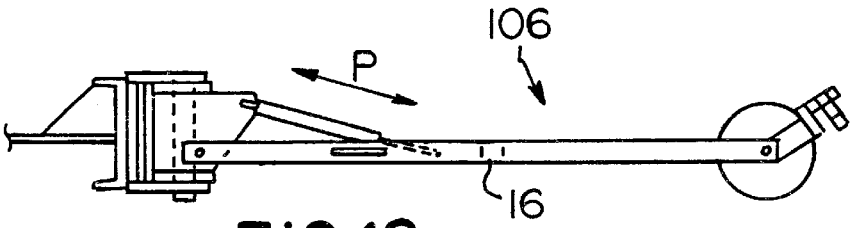
FIG. 18 is an elevation view of the device for lubricating a rail in a second or intermediate position.

After lubrication is complete, an operator may grab the handles 110 and pivot the frames 16 about the pivot pin 74 (and about the Z-axis) to first a second or intermediate position 106 and then to a third or disengaged position 108, which is a position disengaged from the rail, as shown in FIGS. 18 and 19, respectively. Due to the arrangement of the gas springs 84 and 86 known as an over the center arrangement, the frame 16 is maintained in the disengaged position 108 because the gas springs 84 and 86 again apply a pushing force P toward the frame 16. The pickup truck 4 can now continue either on the rails 3 or on the road without the lubricators 10 engaged with the rails 3. This arrangement will prolong the life of the rollers 24. Further, preferably, the frame 16 maintains the disengaged position 108 by placing the lock pins 81 and 82 through the holes 83A and 83B and the holes defined in the tabs of plates 52 and 54. When the lubricators 10 are to be engaged with the rails 3, then the lock pins 81 and 82 are removed and the operator moves the frame 16 from the disengaged third position 108 to the first position 104 via the handles 110.

The present invention results in lubricant applied accurately to the rails 3. The use of the gas springs permits proper engagement of the rollers 24 with the rails 3 and applies a pushing force P against the frames 16 so as to maintain the rollers 24 engagement with the rails 3. Further, the arrangement of the gas springs 84 and 86 permit the frame to be maintained in a disengaged position 108 as well as the engaged position 104. Finally, the pivot frame 42 permits the frames 16 to pivot when the pickup truck 4 makes turns on the rails 3 resulting in improved performance of the lubricators 10 and results in minimum wear of the rollers 24. Alternatively, extension springs can be provided in lieu of the gas springs 84 and 86.

Figure 19A:
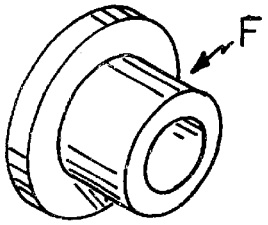
FIGS. 19A–19D show another embodiment of the present invention that includes a flanged wheel and tension spring.
Figure 19C:
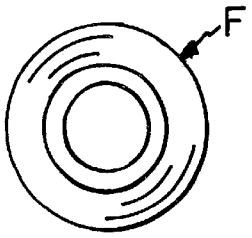
Figure 19B:
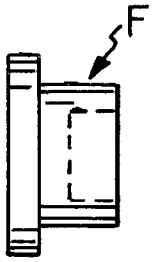
Figure 19D:
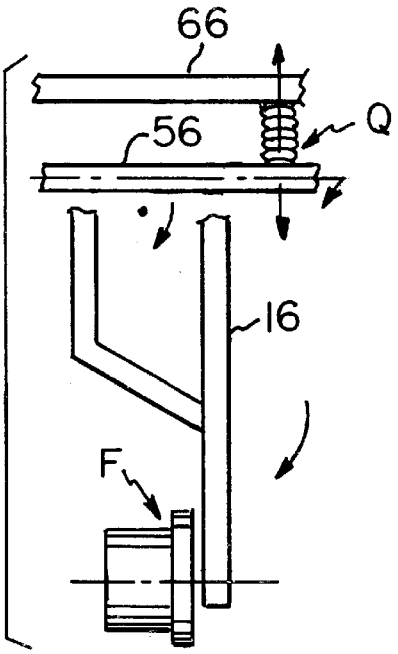
Figure 20:
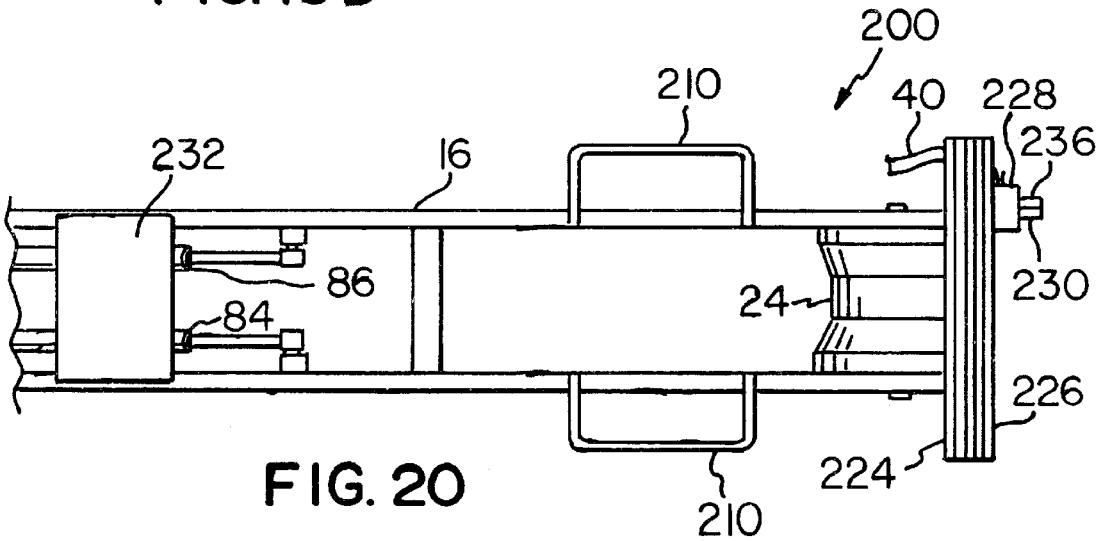
FIG. 20 is a top plan view of another embodiment of a rail lubricator made in accordance with the present invention.
Figure 21:
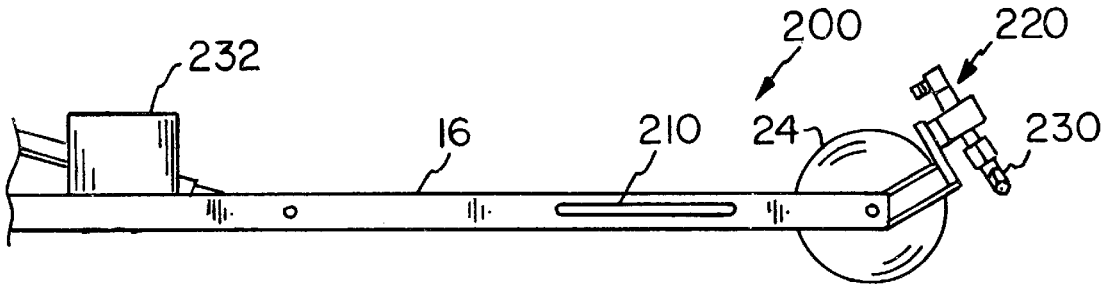
FIG. 21 is an elevation of the rail lubricator shown in FIG. 20.
Figure 22:
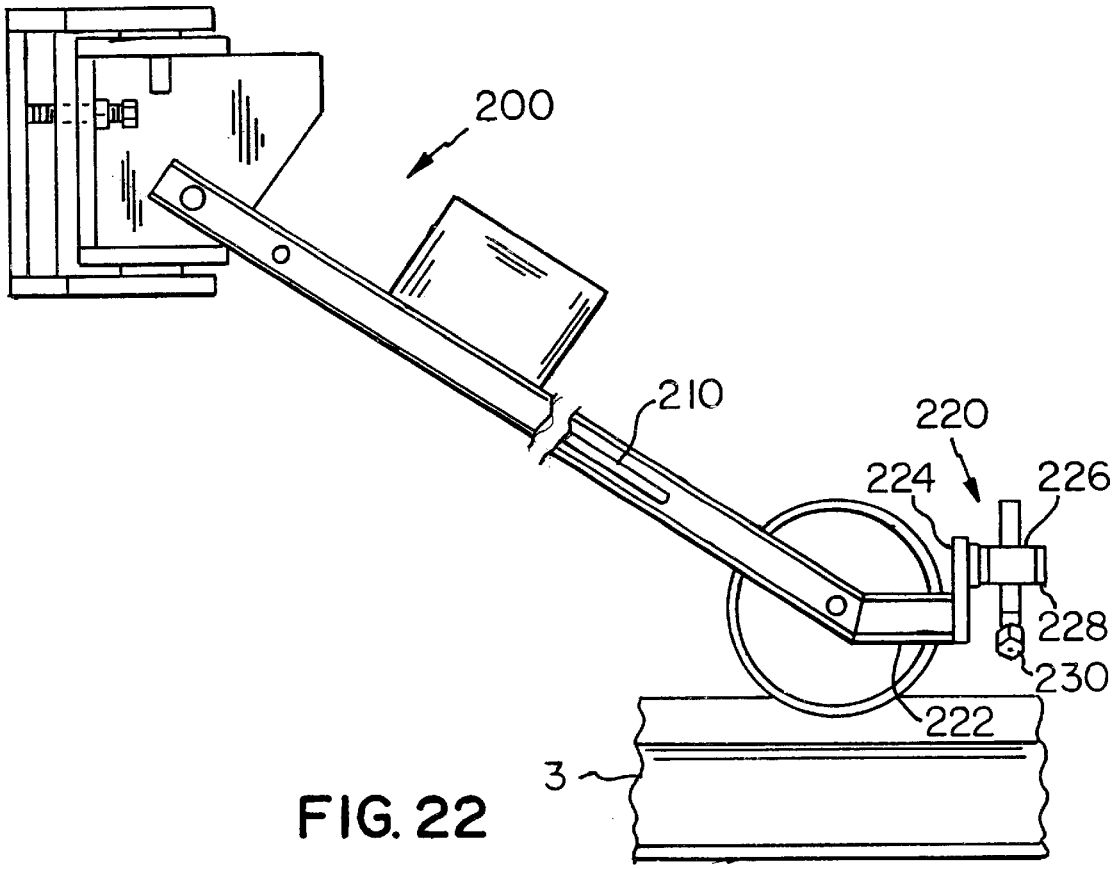
FIG. 22 is an elevation of the rail lubricator shown in FIG. 20 engaged with a rail.
Figure 23:
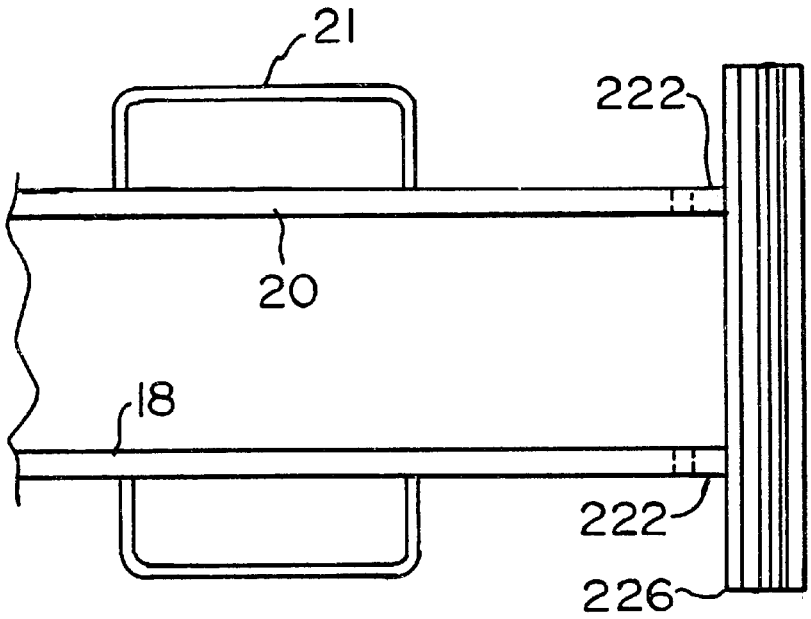
FIG. 23 is a top plan view of a portion of the rail lubricator shown in FIG. 20.
Figure 24:
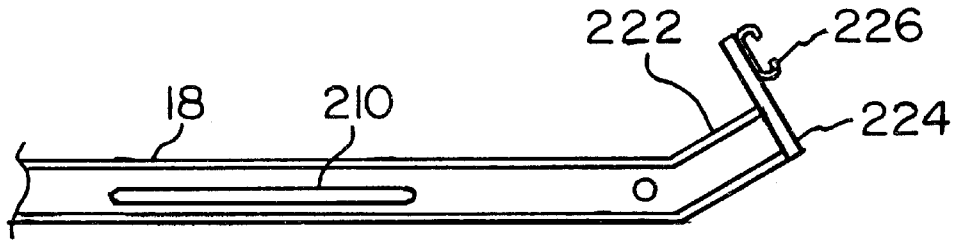
FIG. 24 is an elevation of the portion of the rail lubricator shown in FIG. 23.
Figure 25:
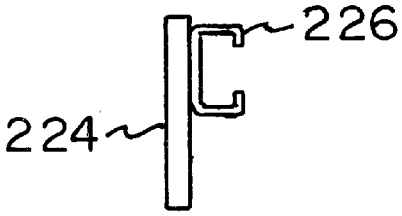
FIG. 25 is an elevation of a mounting channel of the rail lubricator shown in FIG. 20.

An optional centering spring such as a torsional spring S, shown in phantom, may be provided and have one end secured between the face plate 48 and another end secured to the upper plate 62 so that the pivot bracket 46 can be maintained in a central or straight position as shown in FIG. 5. In this manner, a rotational force or torsional force will be applied to the pivot bracket 46, and in turn the frame 16, should the pivot bracket 46 pivot or move from the central or straight position. This will minimize the tendency of the roller 24 to leave the rails 3 due to sharp turns of the rails 3. Alternatively, a standard flanged rail wheel can be provided in lieu of the roller 24 and an extension spring Q, shown in phantom in FIG. 5, can be provided secured to plates 56 and 66 so as to abut the flange against the rail 3. FIGS. 19A–19C show such a flanged wheel F and FIG. 19D shows the extension spring Q. Finally, the stops 58 and 60 are threaded members, which are threadably adjustable to limit the pivotable movement of the pivot bracket 46 relative to the mounting bracket frame 44. Should the pivot bracket 46 rotate above a fixed value, the stops 58 and 60 will contact rear plate 64 preventing additional rotation about the shaft 68. Alternatively, the stops 58 and 60 could be provided on the rear plate 64 to contact the pivot bracket 46 to limit rotation.

FIGS. 20–25 show a second embodiment of rail lubricator 200 made in accordance with the present invention. The rail lubricator 200 is similar to the rail lubricator 10, except for the below noted differences. Like reference numerals will be used for like parts. Handles 210 are positioned closer to the first end 30 of the frame 16 of the rail lubricator 200 than the rail lubricator 10.

The rail lubricator 200 includes a nozzle assembly 220 that differs from the nozzle assembly 32 of the rail lubricator 10. Specifically, the nozzle assembly 220 includes two extension channels 222 extending forwardly from the arms 18 and 20. A bar stock 224 is secured to the channels 222. A clamp mounting channel 226 is secured to the bar stock 224. A nozzle clamp 228 is slidably received by the clamp mounting channel 226. Such an arrangement is manufactured by Stauff Corporation of 7WM Demerest Pl., Waldick, N.J. 07463, U.S.A. A nozzle 230 is secured to the nozzle clamp 228. The position of the nozzle 230 relative to the rail 3 is adjusted by sliding the nozzle clamp 228 in the mounting channel 226.

A further difference between the rail lubricator 200 and rail lubricator 10 is the inclusion of a stiffening brace 232 secured to the arms 18 and 20. Furthermore, tabs T are eliminated in the rail lubricator 200.

Figure 26:
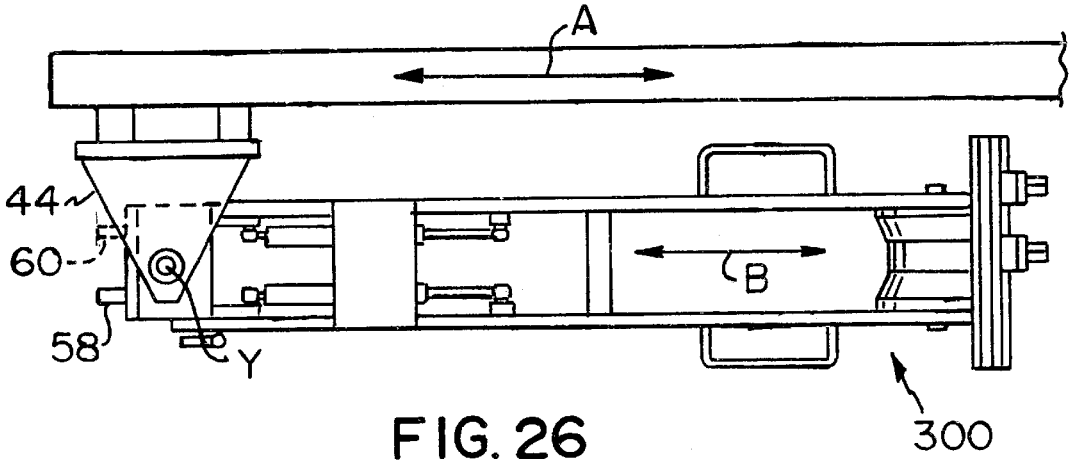
FIG. 26 is a top plan view of another embodiment.
Figure 27:
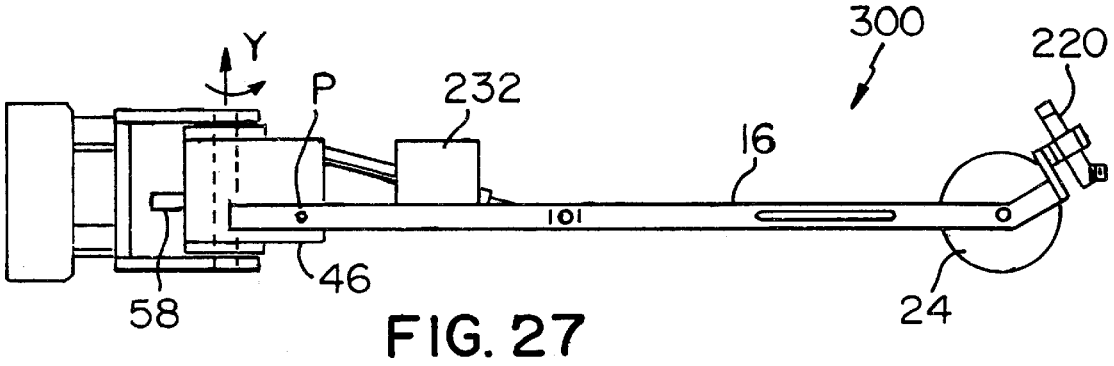
FIG. 27 is an elevation view of the embodiment shown in FIG. 26.

FIGS. 26 and 27 show another arrangement of a rail lubricator 300 that incorporates the features of the rail lubricator 200 except that it can swivel about the Y-axis with the lubricator in a horizontal position, such as shown in FIG. 27, and moved in a stowed position, substantially parallel to a tail gate or bumper of a vehicle. In this arrangement, the bumper 12 extends along an axis A and the frame 16 is adapted to be pivoted about the second end so that the frame 16 extends along an axis B parallel to the axis A. The bumper 12 extends along so that the frame 16 is in a stowed position. A removable pin P is provided for coacting with the mounting frame 46 and the frame 16 to maintain the frame 16 in the stowed position.

Having described the presently preferred embodiments of the present invention, it is to be understood that it may otherwise be embodied within the scope of the appended claims.

We claim:

1. A device for lubricating a rail, comprising:

a mounting frame, said mounting frame comprising a mounting bracket frame pivotally secured to a pivot bracket;

a first support frame having a first end and a second end, said second end pivotally secured to said pivot bracket;

a roller rotatably secured to said first end of said first support frame and adapted to ride on a rail, said roller adapted to rotate about a first axis relative to said first support frame, said pivot bracket and said first support frame pivot about a second axis relative to said mounting bracket frame and said first support frame pivots about a third axis relative to said pivot bracket, wherein the first axis and the third axis are parallel to each other and the second axis is not parallel to the first axis and the third axis; and a lubricating nozzle mounted to said first support frame for directing lubricant toward a rail.

2. A device for lubricating a rail as claimed in claim 1, further comprising:

a biasing member having two ends, one end mounted to said mounting frame and said other end mounted to said first support frame.

3. A device for lubricating a rail as claimed in claim 2, wherein said biasing member assists in maintaining said support frame in a first position and a second position, the first position maintains said roller in an engaged position with a rail and the second position maintains the roller in a disengaged position.

4. A device for lubricating a rail as claimed in claim 2, wherein said biasing member includes a gas charged chamber and a piston slidably received by said chamber, said piston biased relative to said chamber, one of said piston and said chamber pivotally secured to said mounting frame and the other of said piston and said chamber pivotally mounted to said first support frame.

5. A device for lubricating a rail as claimed in claim 1, wherein said roller includes a tapered surface defining a recess adapted to receive a portion of a rail.

6. A device for lubricating a rail as claimed in claim 5, wherein said tapered surface includes a first tapered surface spaced apart from a second tapered surface.

7. A device for lubricating a rail as claimed in claim 6, wherein said first tapered surface is dissimilar from said second tapered surface.

8. A device for lubricating a rail as claimed in claim 7, wherein said first tapered surface and said second tapered surface are frusto-conical shaped and have differing base diameters.

9. A device for lubricating a rail as claimed in claim 1, wherein said roller is made of an electrically insulating material.

10. A device for lubricating a rail as claimed in claim 1, further comprising a stop secured to one of said mounting bracket frame and said pivot bracket adapted to contact the other of said pivot bracket and said mounting bracket frame to limit pivotal movement of said pivot bracket relative to said mounting bracket frame.

11. A device for lubricating a rail as claimed in claim 10, wherein said stop is adjustable to adjust the limited pivotal movement of said pivot bracket relative to said mounting bracket frame.

12. A device for lubricating a rail as claimed in claim 10, wherein said stop is a threaded member threadably received by said pivot bracket.

13. A device for lubricating a rail as claimed in claim 1, further comprising a second lubricating nozzle mounted to said first support frame for directing a lubricant toward a rail, one of said lubricating nozzles arranged to direct a lubricant toward a top portion of the rail and the other of said lubricating nozzles arranged to direct a lubricant toward a gauge face of the rail.

14. A device for lubricating a rail as claimed in claim 1, wherein said first support frame comprises two spaced apart arms.

15. A device for lubricating a rail as claimed in claim 14, wherein said roller is positioned between said arms.

16. A device for lubricating a rail as claimed in claim 1, further comprising a centering spring having two ends, one end secured to said mounting bracket frame and said other end mounted to said pivot bracket.

17. A device for lubricating a rail as claimed in claim 16, wherein said centering spring is a torsional spring.

18. A device for lubricating a rail as claimed in claim 1, further comprising a bumper, said mounting frame secured to said bumper.

19. A device for lubricating a rail as claimed in claim 18, further comprising:

a second mounting frame secured to said bumper;

a second support frame having a first end and a second end, said first end of said second support frame pivotally secured to said second mounting frame;

a second roller rotatably secured to said second end of said second support frame and adapted to ride on a rail, said second roller adapted to rotate about an axis relative to said second support frame; and a second lubricating nozzle mounted to said second support frame for directing lubricant toward a rail, wherein said mounting frames are spaced apart from each other.

20. In combination, a device for lubricating a rail and a wheeled vehicle having a bumper, said device for lubricating a rail, comprising:

a mounting frame secured to said bumper, said mounting frame comprising a mounting bracket frame pivotally secured to a pivot bracket;

a first support frame having a first end and a second end, said second end pivotally secured to said pivot bracket;

a roller rotatably secured to said first end of said first support frame and adapted to ride on a rail, said roller adapted to rotate about a first axis relative to said first support frame, said pivot bracket and said first support frame pivot about a second axis relative to said mounting bracket frame and said first support frame pivots about a third axis relative to said pivot bracket, wherein the first axis and the third axis are parallel to each other and the second axis is not parallel to the first axis and the third axis; and a lubricating nozzle mounted to said first support frame for directing lubricant toward a rail.

21. A device for lubricating a rail as claimed in claim 18, wherein said bumper extends along a fourth axis and said first support frame adapted to be pivoted about said second end so that said first support frame extends along an axis parallel to the fourth axis so that the first support frame is in a stowed position.

22. A device for lubricating a rail as claimed in claim 21, further comprising a removable pin coacting with said mounting frame and said first support frame in the stowed position.

23. A device for lubricating a rail as claimed in claim 1, further comprising a bracket secured to said first support frame wherein said nozzle is slidably secured to said bracket.

24. A device for lubricating a rail, comprising:

a mounting frame, said mounting frame comprising a mounting bracket frame pivotally secured to a pivot bracket;

a first support frame having a first end and a second end, said second end pivotally secured to said pivot bracket;

a roller rotatably secured to said first end of said first support frame and adapted to ride on a rail, said roller adapted to rotate about a first axis relative to said first support frame;

a lubricating nozzle mounted to said first support frame for directing lubricant toward a rail; and a stop secured to one of said mounting bracket frame and said pivot bracket adapted to contact the other of said pivot bracket and said mounting bracket frame to limit pivotal movement of said pivot bracket relative to said mounting bracket frame, wherein said stop is a threaded member threadably received by said pivot bracket.

25. A device for lubricating a rail, comprising:

a mounting frame, said mounting frame comprising:

a mounting bracket frame pivotally secured to a pivot bracket;

a first support frame having a first end and a second end, said second end pivotally secured to said pivot bracket;

a roller rotatably secured to said first end of said first support frame and adapted to ride on a rail, said roller adapted to rotate about a first axis relative to said first support frame;

a lubricating nozzle mounted to said first support frame for directing lubricant toward a rail; and a centering spring having two ends, one end secured to said mounting bracket frame and said other end mounted to said pivot bracket.

26. A device for lubricating a rail as claimed in claim 25, wherein said centering spring is a torsional spring.

27. A device for lubricating a rail as claimed in claim 18, wherein said bumper extends along a second axis and said first support frame adapted to be pivoted so that said first support frame extends along an axis parallel to the second axis so that the first support frame is in a stowed position.

* * * * *

UNITED STATES PATENT AND TRADEMARK OFFICE

CERTIFICATE OF CORRECTION

PATENT NO. : 6,374,948 B1
DATED : April 23, 2002
INVENTOR(S) : Daniel P. Stack et al.

It is certified that error appears in the above-identified patent and that said Letters Patent is hereby corrected as shown below:

Title page,
Item [56], References Cited, U.S. PATENT DOCUMENTS, refer to Patent No. 3,542,153, "Philips" should read -- Phillips --.
Item [57], ABSTRACT,
Line 2, "mounted tog" should read -- mounted to a --.

Column 2,
Line 16, after "third" insert -- axis. --

Signed and Sealed this

Fifteenth Day of October, 2002

*Attest:*

*Attesting Officer*

JAMES E. ROGAN
*Director of the United States Patent and Trademark Office*